US006833082B2

(12) United States Patent
Yamaguchi et al.

(10) Patent No.: US 6,833,082 B2
(45) Date of Patent: Dec. 21, 2004

(54) STAIN BLOCK TREATMENT OF TEXTILE

(75) Inventors: Fumihiko Yamaguchi, Settsu (JP); Ikuo Yamamoto, Settsu (JP); Teruyuki Fukuda, Settsu (JP); Kayo Kusumi, Settsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 10/058,376

(22) Filed: Jan. 30, 2002

(65) Prior Publication Data

US 2002/0189023 A1 Dec. 19, 2002

(30) Foreign Application Priority Data

Jan. 31, 2001 (JP) ..... 2001-023855

(51) Int. Cl.[7] ..... D06M 15/55; B05D 3/02; B32B 3/02

(52) U.S. Cl. ..... 252/8.61; 252/8.62; 252/8.63; 252/8.84; 8/115.44; 427/315; 428/96

(58) Field of Search ..... 8/115.44; 252/8.84; 427/315; 428/96

(56) References Cited

U.S. PATENT DOCUMENTS

| | | | | |
|---|---|---|---|---|
| 4,937,123 | A | 6/1990 | Chang et al. | |
| 5,073,442 | A | 12/1991 | Knowlton et al. | |
| 5,516,337 | A | 5/1996 | Nguyen | |
| 5,520,962 | A | 5/1996 | Jones, Jr. | |
| 6,197,378 | B1 * | 3/2001 | Clark et al. | 427/315 |

FOREIGN PATENT DOCUMENTS

| | | |
|---|---|---|
| EP | 0 332 342 | 2/1989 |
| JP | 1-280076 | 11/1989 |
| WO | WO 98/50619 | 11/1998 |

* cited by examiner

*Primary Examiner*—Margaret Einsmann
*Assistant Examiner*—Preeti Kumar
(74) *Attorney, Agent, or Firm*—Sughrue Mion, PLLC

(57) ABSTRACT

Excellent stain block property, WAQE resistance and yellowing resistance are imparted to a textile by a method of preparing a treated textile has the steps of (1) preparing a treatment liquid comprising a stain blocking agent and a sulfated castor oil and having pH of at most 7, (2) applying the treatment liquid to the textile, (3) treating the textile with steam, and (4) washing the textile with water and dehydrating the textile.

14 Claims, No Drawings

STAIN BLOCK TREATMENT OF TEXTILE

FIELD OF THE INVENTION

The present invention relates to a treatment for imparting excellent stain block property (stain resistance), WAQE resistance (stain block property after alkaline treatment) and yellowing resistance to a textile. A method of the present invention is particularly useful for carpet.

BACKGROUND OF THE INVENTION

Hitherto, various treatment methods have been proposed in order to impart a stain block property to a textile such as a carpet. For example, a process of treating a textile comprising decreasing a pH of a treatment liquid, applying the treatment liquid to the textile, thermally treating the textile with steam, washing the textile with water, and dehydrating the textile (hereinafter, sometimes referred to as "Exhaust process") is proposed.

A method comprising the Exhaust process is proposed in U.S. Pat. Nos. 5,073,442, 5,520,962 and 5,516,337, and International Publication WO 98/50619.

U.S. Pat. No. 5,073,442 discloses a method of treating a textile, comprising conducting an Exhaust process by using a water- and oil-repellent agent comprising a fluorine-containing compound, a formaldehyde condensation product and an acrylic polymer. U.S. Pat. No. 5,520,962 discloses a method of treating a carpet, comprising conducting an Exhaust process by using a fluorine-containing compound and a polymeric binder. U.S. Pat. No. 5,516,337 discloses a method of treating a textile, comprising conducting an Exhaust process by using a fluorine-containing water- and oil-repellent agent and a metal compound such as aluminum sulfate. International Publication WO 98/50619 discloses a method of treating a carpet, comprising conducting an Exhaust process by using a fluorine-containing water- and oil-repellent agent and a salt such as a magnesium salt.

Sufficient stain block property cannot be obtained by conducting the Exhaust process in accordance with these methods.

SUMMARY OF THE INVENTION

An object of the present invention is to give a textile excellent in stain block property, WAQE resistance (stain block property after alkaline treatment) and yellowing resistance, when an Exhaust process is used.

The present invention provides a method of preparing a treated textile, comprising steps of:

(1) preparing a treatment liquid comprising a stain blocking agent and a sulfated castor oil and having pH of at most 7, (2) applying the treatment liquid to the textile, (3) treating the textile with steam, and (4) washing the textile with water and dehydrating the textile.

The present invention also provides a textile prepared by the above-mentioned method, and a treatment liquid used in the above-mentioned method.

DETAILED DESCRIPTION OF THE INVENTION

The procedure used in the present invention is an Exhaust process which comprises decreasing the pH of the pH-unadjusted treatment liquid comprising the stain blocking agent and the sulfated castor oil, applying the treatment liquid to the textile, thermally treating the textile, washing the textile with water, and dehydrating the textile.

In the step (1) of the method of the present invention, the treatment liquid comprising the stain blocking agent and the sulfated castor oil, which is applied to the textile, is prepared. The treatment liquid comprises comprising the stain blocking agent and the sulfated castor oil may be in the form of a solution or emulsion, particularly an aqueous emulsion. The treatment liquid can be prepared by mixing the stain blocking agent, the sulfated castor oil and water. The treatment liquid has the pH of at most 7. The pH of the treatment liquid is preferably at most 4, more preferably at most 3, for example, at most 2.5. The pH can be decreased by addition of an acid such as an aqueous solution of citraconic acid and an aqueous solution of sulfamic acid to the treatment liquid.

The stain blocking agent is preferably a phenol/formaldehyde condensate, an acrylic polymer, or a mixture of phenol/formaldehyde condensate and acrylic polymer. Examples of the phenol/formaldehyde condensate include a sulfonated phenol resin. Examples of the acrylic polymer include a methacrylic acid-based polymer (for example, a homopolymer of methacrylic acid, a copolymer of methacrylic acid, for example, a methacrylic acid/butyl methacrylate copolymer).

The sulfated castor oil mainly (for example, at the amount of at least 40% by weight, particularly at least 60% by weight) contains an ester between sulfuric acid and glyceride of ricinolic acid. Generally, the sulfated castor oil also contains esters between sulfuric acid and glycerides of oleic acid, linoleic acid, palmitic acid and/or stearic acid. Specific examples of the sulfated castor oil include, for example, a compound of the following formula:

$$CH_3(CH_2)_7CH(OSO_3Na)CH(CH_2)_7COOC_4H_9$$

The treatment liquid may contain a salt, particularly a metal salt. The salt may be, for example, a salt of monovalent or divalent metal. Examples of the salt include LiCl, NaCl, NaBr, NaI, $CH_3COONa$, KCl, CsCl, $LI_2SO_4$, $Na_2SO_4$, $NH_4Cl$, $(NH_4)_2SO_4$, $(CH_3)_4NCl$, $MgCl_2$, $MgSO_4$, $CaCl_2$, $Ca(CH_3COO)_2$, $SrCl_2$, $BaCl_2$, $ZnCl_{21}$, $ZnSO_4$, $FeSO_4$, $CuSO_4$, HCOOLi, HCOOK, HCOONa, $(HCOO)_2Ca$, HCOOCs, $HCOONH_4$, $CH_3COOLi$, $CH_3COOK$, $(HCOO)_2Mg$, $(CH_3COO)_2Mg$, $(CH_3COO)_2Ca$, $(CH_3COO)_2Zn$, $(COOK)_2$ and $(COONa)_2$.

In the step (2) of the method of the present invention, the treatment liquid is applied to the textile. The treatment liquid can be applied to a substrate to be treated (that is, the textile) by a know procedure. The application of the treatment liquid can be conducted by immersion, spraying and coating. Usually, the treatment liquid is diluted with an organic solvent or water, and is adhered to surfaces of the substrate by a well-known procedure such as an immersion coating, a spray coating and a foam coating to a fabric (for example, a carpet cloth), a yarn (for example, a carpet yarn) or an original fiber. If necessary, the treatment liquid is applied together with a suitable crosslinking agent, followed by curing. It is also possible to add mothproofing agents, softeners, antimicrobial agents, flame retardants, antistatic agents, paint fixing agents, crease-proofing agents, etc. to the treatment liquid.

The concentration of the stain blocking agent in the treatment liquid contacted with the substrate may be from 0.05 to 20% by weight, particularly from 0.1 to 10% by weight. The concentration of the sulfated castor oil in the treatment liquid may be from 0.01 to 20% by weight, particularly from 0.05 to 15% by weight.

In the step (3) of the method of the present invention, the textile is thermally treated. The thermal treatment can be conducted by applying a steam (for example, 80 to 110° C., particularly 90 to 110° C.) to the textile under a normal pressure for e.g., 10 seconds to 30 minutes.

In the step (4) of the method of the present invention, the textile is washed with water and dehydrated. The thermally treated textile is washed with water at least once. Then, in order to remove excess water, the textile is dehydrated by a usual dehydration procedure such as a centrifuging and vacuuming procedure.

After the step (4), the textile can be dried.

The substrate to be treated in the present invention is preferably a textile, particularly a carpet. The textile includes various examples. Examples of the textile include animal- or vegetable-origin natural fibers such as cotton, hemp, wool and silk; synthetic fibers such as polyamide, polyester, polyvinyl alcohol, polyacrylonitrile, polyvinyl chloride and polypropylene; semisynthetic fibers such as rayon and acetate; inorganic fibers such as glass fiber, carbon fiber and asbestos fiber; and a mixture of these fibers. The present invention can be suitably used in carpets made of nylon fibers, polypropylene fibers and/or polyester fibers, because the present invention provides excellent resistance to a detergent solution and brushing (mechanical).

The textile may be in any form such as a fiber, a yarn and a fabric. When the carpet is treated according to the method of the present invention, the carpet may be formed after the fibers or yarns are treated according to the present invention, or the formed carpet may be treated according to the present invention.

PREFERABLE EMBODIMENT OF THE INVENTION

The following Examples further illustrate the present invention in detail but are not to be construed to limit the scope thereof. The test procedures used in Examples and Comparative Examples are as follows:

Stain Block (SB) property Test

The test is conducted according to AATCC Test Method 175–1993.

A carpet (10 cm×10 cm) treated with a stain blocking agent is stored in a thermo-hygrostat having a temperature of 21° C. and a humidity of 65% for 24 hours. 100 mg of Red 40 (a red dye) is dissolved in 1 L of water and pH of the aqueous Red 40 solution is adjusted to 2.8 by adding citric acid. 20 mL of the aqueous Red solution is weighed in a cup. After a ring for the SB property test is placed on a middle of the carpet, 20 mL of the aqueous Red 40 solution is poured into the ring. The cup was moved up and down five times in the ring. The carpet is stored in a thermo-hygrostat having a temperature of 21° C. and a humidity of 65% for 24 hours. Then, the carpet is sufficiently washed with water, centrifugally dehydrated and dried at 100° C. for 15 minutes. The appearance of the carpet is visually evaluated by an AATCC Red 40 stain scale. The SB property is evaluated as ten levels of 1, 2, 3, 4, 5, 6, 7, 8, 9 and 10 which are from a fully dyed red state to a never dyed state.

WAOE Resistance

Water was added to 7.4 g of sodium lauryl sulfate to give a total amount of 1000 g of a diluted liquid. A pH of the diluted liquid was adjusted to 10 by adding a 10% aqueous solution of trisodium phosphate. The carpet is immersed in this liquid, washed with running water for ten seconds, centrifugally dehydrated to give WPU of 25%, and dried at room temperature. The above SB property test was conducted for the carpet.

Yellowing (Discoloration) Property Test

The test is according to AATCC Test Method 164–1992.

A color difference of a carpet (6 cm×6 cm) treated with a stain blocking agent and a control ribbon No. 1 is measured. After the measurement, the carpet and the control ribbon No. 1 are hung and stood for 4 cycles in a test chamber (manufactured by Yamasaki Seiki Kenkyusho Co., Ltd.) having a humidity of 87.5%, a temperature of 40° C. and 500 pphm of $N0_2$. One cycle has been previously determined by measuring the time giving 16.5±1.5 of dE of the control ribbon No. 1. After the completion of 4 cycles, the samples are removed from the chamber. The color difference of the carpet and the control ribbon No. 1 is measured and dE is calculated, and simultaneously the yellowing of the carpet is visually evaluated by an AATCC gray scale. The yellowing visual determination is evaluated as five levels of 1, 2, 3, 4 and 5 which are from a fully yellowing state to a never discolored state.

COMPARATIVE EXAMPLE 1

Water was added to 1 g of a stain blocking agent (a mixture of a phenol/formaldehyde condensate and a polymethacrylic acid in a weight ratio of 50:50) (herein referred to as "A-4") to give a total amount of 100 g of a diluted liquid. A pH of the diluted liquid was adjusted to 1.5 by adding a 10% aqueous sulfamic acid solution to give a treatment liquid.

A carpet (A) (10 cm×10 cm, nylon 6, cut piled, density: 32 oz/yd$^2$) which was washed with water and squeezed to give a WPU of about 25% (WPU: wet pick up) (WPU is 25% when 25 g of liquid is contained in 100 g of carpet.) was immersed in the treatment liquid for 30 seconds. Then, the carpet (A) was squeezed to give the WPU (wet pick up) of 300%. Then, a normal pressure steamer treatment (a temperature of 100° C. to 107° C.) was conducted for 60 seconds under the state that a pile surface of the carpet (A) was upward. Then, the carpet (A) was lightly rinsed with 2 L of water, and centrifugally dehydrated to give the WPU of about 25%. Finally, the carpet was thermally cured at 110° C. for ten minutes. Then, a stain block property test and a WAQE resistance test of the carpet (A) treated with the stain blocking agent were conducted. The results are shown in Table 1.

COMPARATIVE EXAMPLE 2

1 Gram of a stain blocking agent A-4, and 3 g of a 10% aqueous solution of $MgSO_4$ (a metal salt) were mixed and diluted with water to give a total amount of 100 g. A pH of the mixture was adjusted to 1.5 by adding a 10% aqueous solution of sulfamic acid to give a treatment liquid. The carpet (A) was treated with the stain blocking agent according to Comparative Example 1. Then, a stain block property test and a WAQE resistance test of the carpet (A) treated with the stain blocking agent were conducted. The results are shown in Table 1.

EXAMPLE 1

1 Gram of a stain blocking agent A-4, and 0.1 g, 0.25 g, 0.5 g or 1 g of a sulfated castor oil were mixed and diluted with water to give a total amount of 100 g. A pH of the mixture was adjusted to 1.5 by adding a 10% aqueous solution of sulfamic acid to give a treatment liquid. The treatment liquid has the sulfated castor oil concentration of 1 g/L, 2.5 g/L, 5 g/L or 10 g/L in order. The carpet (A) was treated with the stain blocking agent according to Comparative Example 1. Then, a stain block property test and a WAQE resistance test of the carpet (A) treated with the stain blocking agent were conducted. The results are shown in Table 1.

EXAMPLE 2

1 Gram of a stain blocking agent A-4, 3 g of a 10% aqueous solution of $MgSO_4$ (a metal salt) and 0.1 g, 0.25 g, 0.5 g or 1 g of a sulfated castor oil were mixed and diluted with water to give a total amount of 100 g. A pH of the mixture was adjusted to 1.5 by adding a 10% aqueous solution of sulfamic acid to give a treatment liquid. The treatment liquid has the sulfated castor oil concentration of 1 g/L, 2.5 g/L, 5 g/L or 10 g/L in order. The carpet (A) was treated with the stain blocking agent according to Comparative Example 1. Then, a stain block property test and a WAQE resistance test of the carpet (A) treated with the stain blocking agent were conducted. The results are shown in Table 1.

COMPARATIVE EXAMPLE 3

1 Gram of a stain blocking agent A-4 and 3 g of a 10% aqueous solution of $MgSO_4$ (a metal salt) were mixed and diluted with water to give a total amount of 100 g. A pH of the mixture was adjusted to 1.8, 2.0, 2.3 or 4.0 by adding a 10% aqueous solution of sulfamic acid to give a treatment liquid. The carpet (A) was treated with the stain blocking agent according to Comparative Example 1. Then, a stain block property test of the carpet (A) treated with the stain blocking agent was conducted. The results are shown in Table 1.

EXAMPLE 3

1 Gram of a stain blocking agent A-4, 3 g of a 10% aqueous solution of $MgSO_4$ (a metal salt) and 1 g of a sulfated castor oil were mixed and diluted with water to give a total amount of 100 g. A pH of the mixture was adjusted to 1.8, 2.0, 2.3 or 4.0 by adding a 10% aqueous solution of sulfamic acid to give a treatment liquid. The treatment liquid has the sulfated castor oil concentration of 10 g/L. The carpet (A) was treated with the stain blocking agent according to Comparative Example 1. Then, a stain block property test of the carpet (A) treated with the stain blocking agent was conducted. The results are shown in Table 1.

TABLE 1

| | | | Carpet (A) | | |
|---|---|---|---|---|---|
| Stain Blocking agent | pH | $MgSO_4$ [g/L] | Sulfated castor oil [g/L] | SB property evaluation (AATCC) | SB property evaluation after WAQE treatment (AATCC) |
| Comparative Example 1 | | | | | |
| A-4 | 1.5 | 0 | 0 | 6 | 1 |
| Comparative Example 2 | | | | | |
| A-4 | 1.5 | 3 | 0 | 7 | 2 |
| Example 1 | | | | | |
| A-4 | 1.5 | 0 | 1 | 6 | 1 |
| | | | 2.5 | 6 | 1 |
| | | | 5 | 7 | 1 |
| | | | 10 | 8 | 2 |

TABLE 1-continued

| | | | Carpet (A) | | |
|---|---|---|---|---|---|
| Stain Blocking agent | pH | $MgSO_4$ [g/L] | Sulfated castor oil [g/L] | SB property evaluation (AATCC) | SB property evaluation after WAQE treatment (AATCC) |
| Example 2 | | | | | |
| A-4 | 1.5 | 3 | 1 | 8 | 3 |
| | | | 2.5 | 9 | 3 |
| | | | 5 | 10 | 4 |
| | | | 10 | 10 | 8 |
| Comparative Example 3 | | | | | |
| A-4 | 1.8 | 3 | 0 | 4 | |
| | 2.0 | | | 4 | |
| | 2.3 | | | 3 | |
| | 4.0 | | | 2 | |
| Example 3 | | | | | |
| A-4 | 1.8 | 3 | 10 | 10 | |
| | 2.0 | | | 10 | |
| | 2.3 | | | 10 | |
| | 4.0 | | | 8 | |

COMPARATIVE EXAMPLE 4

Water was added to 1 g of a stain blocking agent A-4 to give a total amount of 100 g of a diluted liquid. A pH of the diluted liquid was adjusted to 1.5 by adding a 10% aqueous sulfamic acid solution to give a treatment liquid. A carpet (B) (10 cm×10 cm, nylon 6, cut piled, density: 32 oz/yd$^2$) which was washed with water and squeezed to give a WPU of about 25% (WPU: wet pick up) (WPU is 25% when 25 g of liquid is contained in 100 g of carpet.) was immersed in the treatment liquid for 30 seconds. Then, the carpet (B) was squeezed to give the WPU (wet pick up) of 300%. Then, a normal pressure steamer treatment (a temperature of 100° C. to 107° C.) was conducted for 60 seconds under the state that a pile surface of the carpet (B) was upward. Then, the carpet (B) was lightly rinsed with 2 L of water, and centrifugally dehydrated to give the WPU of about 25%. Finally, the carpet (B) was thermally cured at 110° C. for ten minutes. Then, a stain block property test and a yellowing property test of the carpet (B) treated with the stain blocking agent were conducted. The results are shown in Table 2.

COMPARATIVE EXAMPLE 5

1 Gram of a stain blocking agent A-4, and 3 g of a 10% aqueous solution of $MgSO_4$ (a metal salt) were mixed and diluted with water to give a total amount of 100 g. A pH of the mixture was adjusted to 1.5 by adding a 10% aqueous solution of sulfamic acid to give a treatment liquid. The carpet (B) was treated with the stain blocking agent according to Comparative Example 4. Then, a stain block property test and a yellowing property test of the carpet (B) treated with the stain blocking agent were conducted. The results are shown in Table 2.

EXAMPLE 4

1 Gram of a stain blocking agent A-4, and 1 g of a sulfated castor oil were mixed and diluted with water to give a total amount of 100 g. A pH of the mixture was adjusted to 1.5 by adding a 10% aqueous solution of sulfamic acid to give a treatment liquid. The treatment liquid has the sulfated castor oil concentration of 10 g/L. The carpet (B) was treated with the stain blocking agent according to Comparative Example 4. Then, a stain block property test and a yellowing property test of the carpet (B) treated with the stain blocking agent were conducted. The results are shown in Table 2.

EXAMPLE 5

1 Gram of a stain blocking agent A-4, 3 g of a 10% aqueous solution of $MgSO_4$ (a metal salt) and 1 g of a sulfated castor oil were mixed and diluted with water to give a total amount of 100 g. A pH of the mixture was adjusted to 1.5 by adding a 10% aqueous solution of sulfamic acid to give a treatment liquid. The treatment liquid has the sulfated castor oil concentration of 10 g/L. The carpet (B) was treated with the stain blocking agent according to Comparative Example 4. Then, a stain block property test and a yellowing property test of the carpet (B) treated with the stain blocking agent were conducted. The results are shown in Table 2.

TABLE 2

| | | | Carpet (B) | | | |
|---|---|---|---|---|---|---|
| Stain Blocking agent | pH | $MgSO_4$ [g/L] | Sulfated castor oil [g/L] | SB property evaluation (AATCC) | Yellowing property evaluation AATCC | dE |
| Comparative Example 4 | | | | | | |
| A-4 | 1.5 | 0 | 0 | 4 | 1 | 7.88 |
| Comparative Example 5 | | | | | | |
| A-4 | 1.5 | 3 | 0 | 5 | 2 | 7.41 |
| Example 4 | | | | | | |
| A-4 | 1.5 | 0 | 10 | 6 | 3 | 5.15 |
| Example 5 | | | | | | |
| A-4 | 1.5 | 3 | 10 | 9 | 4 | 4.87 |

COMPARATIVE EXAMPLE 6

Water was added to 1 g of a stain blocking agent A-4 to give a total amount of 100 g of a diluted liquid. A pH of the diluted liquid was adjusted to 1.5 or 2.6 by adding a 10% aqueous sulfamic acid solution to give a treatment liquid. A carpet (C) (10 cm×10 cm, nylon 6, cut piled, density: 32 oz/yd$^2$) which was washed with water and squeezed to give a WPU of about 25% (WPU: wet pick up) (WPU is 25% when 25 g of liquid is contained in 100 g of carpet.) was immersed in the treatment liquid for 30 seconds. Then, the carpet (C) was squeezed to give the WPU (wet pick up) of 300%. Then, a normal pressure steamer treatment (a temperature of 100° C. to 107° C.) was conducted for 60 seconds under the state that a pile surface of the carpet (C) was upward. Then, the carpet (C) was lightly rinsed with 2 L of water, and centrifugally dehydrated to give the WPU of about 25%. Finally, the carpet (C) was thermally cured at 110° C. for ten minutes. Then, a stain block property test and a yellowing property test of the carpet (C) treated with the stain blocking agent were conducted. The results are shown in Table 3.

EXAMPLE 6

1 Gram of a stain blocking agent A-4 and 10 g of a 10% aqueous sodium acetate (a metal salt of organic acid) solution were mixed and diluted with water to give a total amount of 100 g. A pH of the mixture was adjusted to 1.5 or 2.6 by adding a 10% aqueous solution of sulfamic acid to give a treatment liquid. The treatment liquid has the sodium acetate concentration of 10 g/L. The carpet (C) was treated with the stain blocking agent according to Comparative Example 6. Then, a stain block property test and a yellowing property test of the carpet (C) treated with the stain blocking agent were conducted. The results are shown in Table 3.

EXAMPLE 7

1 Gram of a stain blocking agent A-4, 10 g of a 10% aqueous sodium acetate (a metal salt of organic acid) solution and 1 g of sulfated castor oil were mixed and diluted with water to give a total amount of 100 g. A pH of the mixture was adjusted to 1.5 or 2.6 by adding a 10% aqueous solution of sulfamic acid to give a treatment liquid. The treatment liquid has the sodium acetate concentration of 10 g/L. The carpet (C) was treated with the stain blocking agent according to Comparative Example 6. Then, a stain block property test and a yellowing property test of the carpet (C) treated with the stain blocking agent were conducted. The results are shown in Table 3.

TABLE 3

| | | | | Carpet (C) | | | |
|---|---|---|---|---|---|---|---|
| Stain Blocking agent | pH | Sodium acetate [g/L] | $MgSO_4$ [g/L] | Sulfated castor oil [g/L] | SB property evaluation (AATCC) | Yellowing property evaluation AATCC | dE |
| Comparative Example 6 | | | | | | | |
| A-4 | 1.5 | 0 | 0 | 0 | 6 | 3 | 7.93 |
| | 2.6 | 0 | 0 | 0 | 3 | 1 | 9.54 |
| Example 6 | | | | | | | |
| A-4 | 1.5 | 10 | 0 | 0 | 9 | 4 | 5.51 |
| | 2.6 | 10 | 0 | 0 | 8 | 3 | 7.17 |
| Example 7 | | | | | | | |
| A-4 | 1.5 | 10 | 0 | 10 | 9 | 5 | 3.56 |
| | 2.6 | 10 | 0 | 10 | 9 | 5 | 2.66 |

EFFECT OF THE INVENTION

The method of the present invention imparts excellent stain block property, WAQE resistance and yellowing resistance to a textile.

What is claimed is:

1. A method of preparing a treated textile, comprising steps of:

(1) mixing a stain blocking agent, a sulfated castor oil and optionally water to prepare a treatment liquid comprising the stain blocking agent and the sulfated castor oil and having pH of at most 7, (2) applying the treatment liquid to the textile, (3) treating the textile with steam, and (4) washing the textile with water and dehydrating the textile, wherein the stain blocking agent is selected from the group consisting of a phenol-formaldehyde condensate, an acrylic polymer and a mixture of a phenol/formaldehyde condensate and acrylic polymer.

2. The method according to claim 1, wherein the treatment liquid in the step (1) contains also a salt.

3. The method according to claim 1, wherein the treatment liquid in the step (1) has pH of at most 4.

4. A textile obtained by the method according to claim 1.

5. A carpet obtained by the method according to claim 1.

6. The carpet according to claim 5, wherein the carpet comprises a nylon fiber, a propylene fiber and/or a polyester fiber.

7. A treatment liquid for use in a method of preparing a treated textile, the method comprising steps of:

(1) preparing a treatment liquid comprising mixing a stain blocking agent and a sulfated castor oil and having pH of at most 7, (2) applying the treatment liquid to the textile, (3) treating the textile with steam, and (4) washing the textile with water and dehydrating the textile where in the treatment liquid comprises a stain blocking agent, a sulfated castor oil, and optionally, water and having a pH of at most 7, and, wherein the stain blocking agent is selected from the group consisting of a phenol-formaldehyde condensate, an acrylic polymer and a mixture of a phenol/formaldehyde condensate and acrylic polymer.

8. The treatment liquid according to claim 7, which contains also a salt.

9. The method according to claim 1, wherein the treatment liquid comprises said sulfated castor oil in an amount of from 0.01 to 20% by weight.

10. The treatment liquid according to claim 7, containing said sulfated castor oil in an amount of from 0.01 to 20% by weight.

11. A method of preparing a treated textile, comprising steps of:

(1) mixing a stain blocking agent, a sulfated castor oil having an unsaturated bond and optionally water to prepare a treatment liquid comprising the stain blocking agent and the sulfated castor oil having an unsaturated bond and having pH of at most 7, (2) applying the treatment liquid to the textile, (3) treating the textile with steam, and (4) washing the textile with water and dehydrating the textile, wherein the stain blocking agent is selected from the group consisting of a phenol-formaldehyde condensate, an acrylic polymer and a mixture of a phenol/formaldehyde condensate and acrylic polymer.

12. A method of preparing a treated textile, comprising steps of:

(1) mixing a stain blocking agent, a sulfated castor oil and optionally water to prepare a treatment liquid consisting essentially of the stain blocking agent and the sulfated castor oil and having pH of at most 7, (2) applying the treatment liquid to the textile, (3) treating the textile with steam, and (4) washing the textile with water and dehydrating the textile, wherein the stain blocking agent is selected from the group consisting of a phenol-formaldehyde condensate, an acrylic polymer and a mixture of a phenol/formaldehyde condensate and acrylic polymer.

13. The treatment liquid according to claim 7, wherein said preparing comprises mixing a stain blocking agent, a sulfated castor oil having an unsaturated bond and optionally water to prepare a treatment liquid comprising the stain blocking agent and the sulfated castor oil having an unsaturated bond and having a pH of at most 7.

14. The treatment liquid according to claim 7, wherein said preparing comprises mixing a stain blocking agent, a sulfated castor oil and optionally water to prepare a treatment liquid consisting essentially of the stain blocking agent and the sulfated castor oil and having a pH of at most 7.

* * * * *